US005338254A

United States Patent [19]

Farrington

[11] Patent Number: 5,338,254

[45] Date of Patent: Aug. 16, 1994

[54] INCREASING JET ENTRAINMENT, MIXING AND SPREADING

[75] Inventor: Robert B. Farrington, Wheatridge, Colo.

[73] Assignee: Midwest Research Institute, Kansas City, Mo.

[21] Appl. No.: 995,146

[22] Filed: Dec. 22, 1992

[51] Int. Cl.[5] ..... F24F 7/007

[52] U.S. Cl. ..... 454/284; 454/256; 454/290; 454/305

[58] Field of Search ..... 454/75, 256, 261, 284, 454/287, 288, 289, 290, 292, 301, 303, 304, 305

[56] References Cited

U.S. PATENT DOCUMENTS

| | | | |
|---|---|---|---|
| 681,215 | 8/1901 | Goll . | |
| 2,212,468 | 8/1940 | Ferris . | |
| 2,972,358 | 2/1961 | Hinden . | |
| 3,242,846 | 3/1966 | Bunn . | |
| 3,777,651 | 12/1973 | Hansen | 454/66 |
| 3,815,485 | 6/1974 | Beusink et al. | 454/338 |
| 3,927,827 | 12/1975 | Strindehag | 454/305 X |
| 4,413,550 | 11/1983 | Piano | 454/144 |
| 4,823,681 | 4/1989 | Gore . | |
| 4,875,624 | 10/1989 | Hara et al. | 454/75 |

*Primary Examiner*—Harold Joyce
*Attorney, Agent, or Firm*—Ken Richardson

[57] ABSTRACT

A free jet of air is disturbed at a frequency that substantially matches natural turbulences in the free jet to increase the entrainment, mixing, and spreading of air by the free jet, for example in a room or other enclosure. The disturbances are created by pulsing the flow of air that creates the free jet at the desired frequency. Such pulsing of the flow of air can be accomplished by sequentially occluding and opening a duct that confines and directs the flow of air, such as by rotating a disk on an axis transverse to the flow of air in the duct.

18 Claims, 6 Drawing Sheets

INCREASING JET ENTRAINMENT, MIXING AND SPREADING

CONTRACTUAL ORIGIN OF THE INVENTION

The United States Government has rights in this invention under Contract No. DE-AC0283CH10093between the U.S. Department of Energy and the National Renewable Energy Laboratory, a Division of Midwest Research Institute.

BACKGROUND OF THE INVENTION

1. Field of the Invention

The present invention relates generally to heating, ventilating, and air conditioning (HVAC) and more particularly to an apparatus and method for increasing entrainment, mixing and spreading of air directed into a room or other enclosure.

2. Description of the State of the Art

Heating, ventilation, and air conditioning (HVAC) systems are installed in modern buildings to enhance comfort. Those systems not only provide warm or cool air, as needed to maintain room temperature within desired ranges, but also supply fresh air to dilute and replace ambient room air that becomes depleted of oxygen due to human consumption, and that becomes polluted by human habitation and other sources, such as chemical release from carpets, paint, copy machines, and the like. Current standards of the American Society of Heating, Refrigerating and Air-Conditioning Engineers (ASHRAE) set in 1989 require a minimum fresh air ventilation rate of 7.1 liters/second/person (15 cfm/person) for general buildings and 9.4 liters/-second/person (20 cfm/person) for office buildings.

Adequate exhausting of pollutants from a room or building is necessary and is accomplished by diluting the pollutants inside with fresh air from outside, while drawing some air out of the room through a return duct. To do so efficiently, the fresh air from outside must be properly distributed in the room to prevent a short circuit of the incoming air flowing directly to the return duct. Such short circuited air streams that flow directly from the fresh air inlet to the outlet or return duct without mixing adequately with the other air in the room cause stagnant air zones, relative discomfort, and inefficient use of energy. Consequently, it is necessary to achieve effective mixing of the incoming air with the ambient air to achieve good ventilation, exhaustion of pollutants, and effective distribution of heated or cooled air.

Introducing or injecting air into a room through a narrow, elongated nozzle or duct outlet to produce a substantially planar (narrow, elongated) jet of air into the room has been found to be a reasonably effective way to achieve mixing of the incoming air with the ambient air in a room by the process of air entrainment. Entrainment is a process of vortex generation, engulfment of ambient fluid, and turbulent transport and includes the dissipation of turbulent energy and momentum transfer from the interior of the jet. However, there is still a need for substantial further improvement.

There have been some apparatus and methods developed for controlling and enhancing the distribution of moving streams of air, in addition to the planar jet and air entrainment process described above. For example, U.S. Pat. No. 3,242,846 issued to Bunn and U.S. Pat. No. 4,823,681 issued to Gore utilize rotating disks located in or near the nozzle outlet of a fresh air ducts to continuously deflect the flow direction of the jets. The Hinden patent, U.S. Pat. No. 2,972,358 discloses a fixed mechanical apparatus for directing the flow of air through ducts. U.S. Pat. No. 681,215 issued to Goll discloses an apparatus for equalizing air flow in rooms or ducts caused by unequal pressure drops. Air is forced through conduits of somewhat equal path lengths resulting in equal pressure drops and more uniform flow distribution. The Ferris patent, U.S. Pat. No. 2,212,468 discloses an adjustable disk that both deflects air and controls the flow rate by constricting the diffuser opening.

The above patents address the issue of poor air distribution by physically deflecting the air to continuously changing directions. A disadvantage of merely deflecting the air is that the fluid structure of the jet (other than being redirected), remains unaffected, thus the mixing and entrainment of the jet remains substantially unchanged. If entrainment could be increased, mixing would be enhanced and should lead to better room air distribution, enhanced dilution and removal of contaminants, and sufficiently low jet velocities to ensure occupant comfort.

SUMMARY OF THE INVENTION

Accordingly, it is a general object of this invention to provide a system for increasing the entrainment, mixing and spreading of an air stream into an enclosure.

A more specific object of the invention is to modify a planar jet of air as it is introduced into the ambient air in an enclosure to enhance spreading of the jet, thus enhancing the entrainment and mixing of the jet with the ambient air.

Additional objects, advantages and novel features of this invention shall be set forth in part in the description that follows, and in part will become apparent to those skilled in the art upon examination of the following specification or may be learned by the practice of the invention. The objects and advantages of the invention may be realized and attained by means of the instrumentalities, combinations, and methods particularly pointed out in the appended claims.

To achieve the foregoing and other objects and in accordance with the purposes of the present invention, as embodied and broadly described therein, the apparatus of this invention may comprise a method and apparatus for disturbing fluid in a free jet of the fluid at a frequency that substantially matches a natural frequency of natural turbulences in a free jet. Such disturbances can be created, for example, by rotating a disk within a conduit about an axis perpendicular to a flow of the fluid in a duct upsteam of free jet thereby creating pulsed pressure variations in the flow of fluid tha extends into the free jet.

BRIEF DESCRIPTION OF THE DRAWINGS

The accompanying drawings, which are incorporated in and form a part of the specifications, illustrate the preferred embodiments of the present invention, and together with the descriptions serve to explain the principles of the invention.

In the Drawings

DETAILED DESCRIPTION OF THE PREFERRED EMBODIMENT

Figure 1:
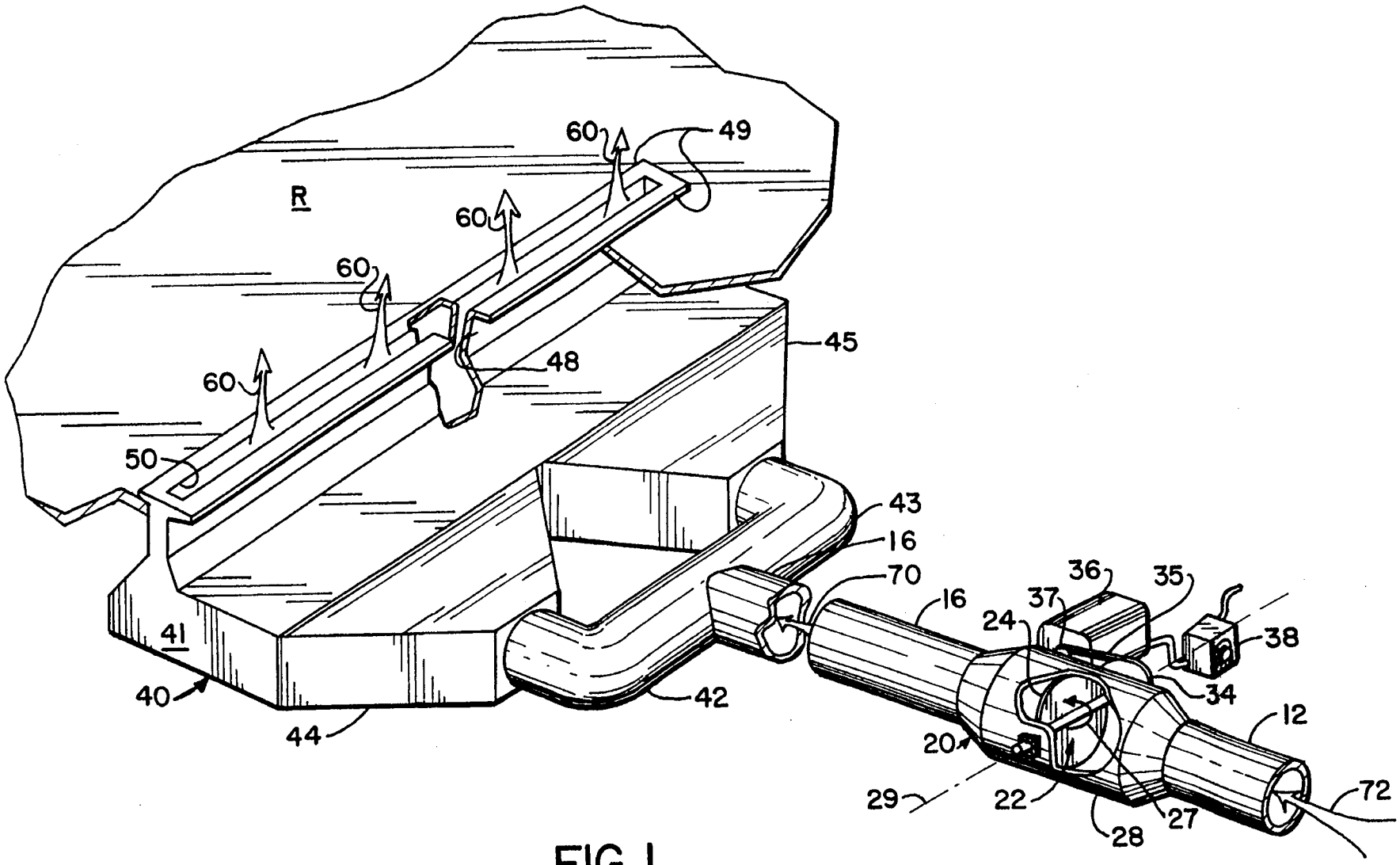
FIG. 1 is a perspective view of the jet excitation system of the present invention installed in combination with an air inlet duct and elongated nozzle with an air diffuser mounted in a floor.

The preferred embodiment jet excitation system 10, according to this invention, is shown in FIG. 1. It comprises a pulsator mechanism 20 positioned in an air delivery duct 12 upstream from a diffuser 40 for imparting periodic pressure pulsations to an air stream 70, that is being delivered into an enclosure, such as a room R in a building. The pressure pulsations in the air flow excite the jet 60 of air injected from the diffuser 40 into the room R in a manner that enhances spreading and increases entrainment and mixing of the jet 60 with the ambient air in the room R, as will be described in more detail below. Essentially, however, pulsing the air stream 70 at a periodic frequency that matches a natural characteristic frequency of the jet 60 causes substantially enhanced spreading of the jet 60 and substantially larger vortices at the edges of the jet 60, thereby resulting in substantially increased entrainment and improved mixing of the fresh air in the jet 60 with the ambient air in the room R.

The pulsator mechanism 20 preferably, although not necessarily, comprises a valve 22 positioned in the duct 12 for alternately occluding and opening the duct 12 to a flow of supply air 72. The supply air 72 may be from a conventional forced air HVAC system, fan, or other source of fresh, heated, or cooled air (not shown), as will be readily understood by persons skilled in the HVAC art. The valve 22 illustrated in FIG. 1, is in the form of a butterfly valve or damper with a disk 24 mounted on a diametral rotatable shaft 26, which extends diametrically through the duct 12. The disk 24 can be either rotated or oscillated on the shaft 26 to alternately occlude and open the duct 12 to the flow of air 72.

Figure 3:
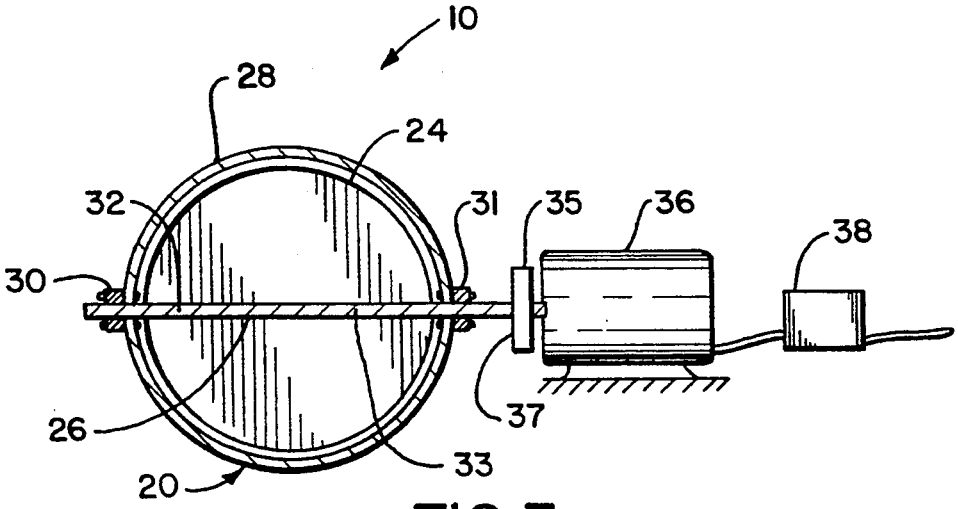
FIG. 3 is a cross-sectional view taken along line 3—3 of FIG. 2 showing a preferred embodiment of the jet excitation mechanism comprising a rotating disk installed in a ventilation duct, and a perspective view of the motor rotating the disk.

In the preferred embodiment illustrated in FIG. 1, the pulsating mechanism 20 includes an enlarged section of duct 12, which forms a valve housing 28. Valve housing 28 may also be formed in a section of duct 12 that is not enlarged. The shaft 26 extends diametrically through the valve housing 28 and is journaled for rotation in beatings 30, 31 mounted in opposite sides of valve housing 28, as best seen in FIG. 3. The disk 24 can be fastened to shaft 26 with appropriate fasteners, such as screws 32, 33, also shown in FIG. 3.

Figure 2:
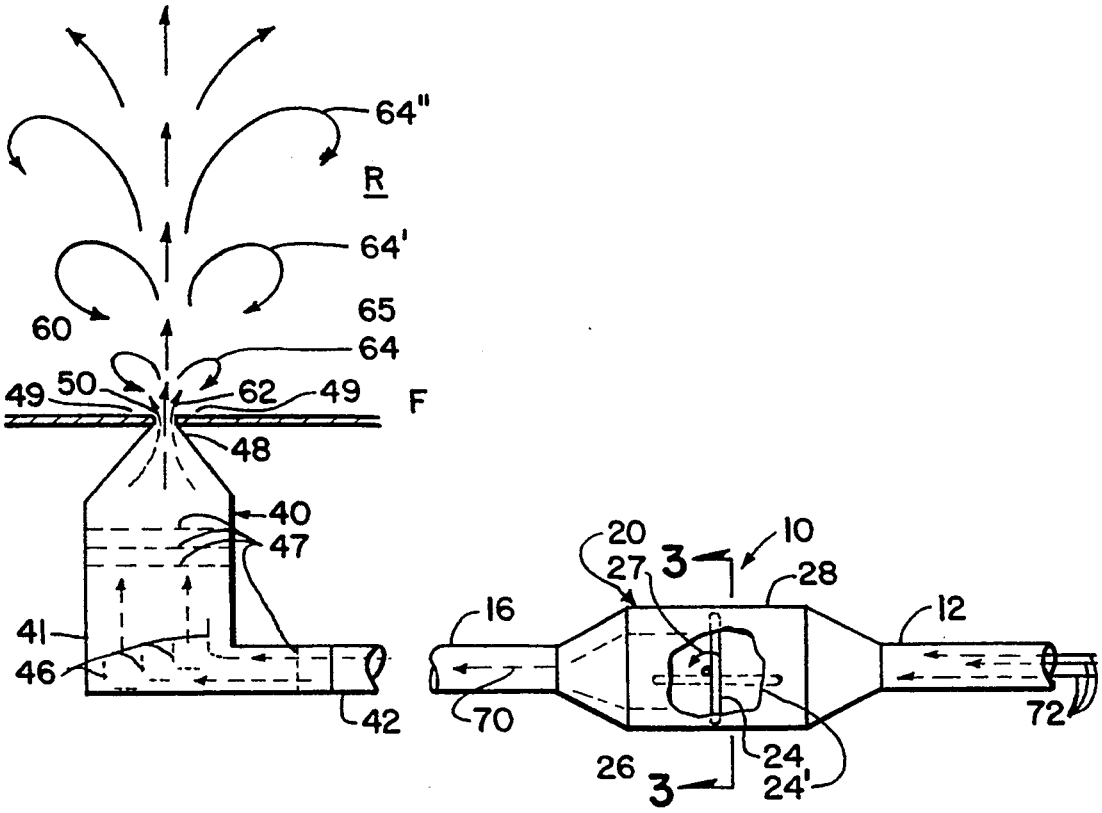
FIG. 2 is a schematic representation of a jet excitation system of the present invention in side elevation view as installed in a ventilation duct upstream from an air diffuser mounted in a floor.

Referring to FIGS. 1, 2, and 3, the disk 24 of valve 22 is rotated, as indicted by arrow 27, about an axis 29 defined by shaft 26 to periodically occlude and open the duct 12 to air flow 72. When the disk 24 is rotated to a plane perpendicular to the longitudinal axis of duct 12, it occludes duct 12, and when it rotates an additional 90° degrees to a plane parallel to the longitudinal axis of the duct 12, as illustrated in broken fines 24' in FIG. 2, the duct 12 is completely open. Of course, degrees of partial occlusion and openness occur at degrees of rotation between those two extremes. When the duct 12 is occluded by disk 24, air flow is restricted, or reduced, in the connecting portion 16 of duct 12 beyond the value 22. On the other hand, when the disk 24 is in the open position 24', the full flow and pressure of air flow 12 is transmitted into the connecting portion 16. The result is a sequence of pressure fronts and rarefaction, thus pressure pluses, of the air flow 70 into diffuser 40. Of course, a smaller disk 24 in the same size housing 28 would result in only partial occlusion of duct 12, thus lower amplitude pressure pulses, if desired. However, as the percent of occlusion decreases, the frequency needed to achieve the same effect increases.

The shaft 26 and disk 24 are rotated in the preferred embodiment by a pulley 34 mounted on shaft 26 outside housing 28 and driven by an electric motor 36 connected to pulley 34 by a motor pulley 37 and belt 35. A variable speed controller 38 is provided to adjust the angular velocity of the rotating disk, thus to adjust the period and frequency of the pressure pulses in the air stream 70.

As mentioned above, instead of rotating disk 24, it could also be oscillated between the occluded and open positions. A wide variety of actuators, such as a crank, pneumatic cylinder, solenoid, or the like could be used to impact such oscillating motion to disk 24. Further, other mechanisms, such as oscillating shutters, fan blades, gates, or any number of other mechanisms could be used to create the pulsed air flow required to practice this invention.

The intermediate connecting portion 16 of duct 12 directs the pulsed air flow 70 into an enlarged plenum 41 of diffuser 40. To help equalize air flow throughout plenum 41, the pulsed stream of air 70 is directed via forked duct sections 42, 43 of duct 12 into respective ends 44, 45 of plenum 41. Also, as illustrated in FIG. 2, a plurality of turning vanes 46 and flow conditioning screens 47 can be used to minimize and dissipate any turbulent structures in the air flow through the plenum 41 and to further ensure equal distribution of air flow and pressure throughout plenum 41.

As mentioned above, the nozzle outlet 50 of the diffuser 40 is preferably, but not necessarily, an elongated, narrow slot, that produces a jet 60 in the shape of an elongated plane (not shown), thus called a planar jet 60. While round nozzles or registers, as well as wider rectangular ones, can also be used beneficially with pulsed air flow according to this invention, the planar jets 60 produced by the enlongated, narrow opening 50 are particularly conducive to excitation by pressure pulsing.

As best illustrated in FIG. 1, the plenum 41 or diffuser narrows to a neck 48 just before the slotted opening on nozzle 50. Flanges 49 around the slotted nozzle 50 facilitate mounting the nozzle in a floor F, or other structure.

The jet 60 of air injected into the room R is forced into the ambient air in the room R. A natural occurrence upon the introduction of a jet 60 at some constant, nonplused velocity into a mass of substantially stagnant air in the room R is the formation of vortices 64 along the edges 62 of the jet 60, as illustrated in FIG. 2. The vortices 64 and following rarefaction 65 produce flow variations that are measurable, such as with a hot-wire anemometry system (not shown) positioned in the jet 60. Detecting the periodic variations produced by the vortices 64 can provide the frequency of vortex 64 formation for a given jet 60.

It has been found, according to this invention that pulsing the air flow 70 in duct 16 and plenum 41 at a natural characteristic frequency, or subharmonics of that frequency, of the jet 60 causes a substantial excitation of the jet 60 and results in substantially larger and more active vortices 64, as well as a substantially increased width of the jet 60 spreading or widening after leaving the nozzle 50. Therefore, the excited jet 60 causes a substantial increase in entrainment and mixing efficiency of the fresh air in the jet 60 with the ambient air in the room R.

The pulse rate or frequency of the pulsating air flow 70 in duct section 16 can be varied or adjusted to match a natural characteristic frequency of the jet 60 by varying the speed of rotation of the disk 24 in valve 22. A variable speed control 38 (FIG. 1) can be provided for this purpose. Each one-half revolution of the disk 24 places the disk at its duct-occluding position once and at its open duct position once, thus causing one pulse. A full revolution of disk 24, therefore, causes two pulses in the duct section 16 and diffuser 40. Therefore, the greatest excitation of the jet 60 results when rotation of disk 24 matches one-half of a natural characteristic frequency of the jet 60. Of course, other valve 22 actuation mechanisms, such as oscillators, pneumatic actuators, and the like, as discussed above, can be regulated in whatever manner is appropriate to the valve structure and actuator used to produce the desired pulse rate according to this invention.

It may also be mentioned that pulsing the air flow 16 at frequencies different than the natural vortical frequency of the jet 60 can produce some excitation of jet 60, that is still within the scope of this invention, albeit not as substantial as, when the pulse frequency is matched with a natural characteristic frequency of the jet 60.

In fact, variations of the pulse frequency from a natural characteristic frequency can lead to waxing and waning periods of excitation and dampening in jet 60 as the beats resulting from the varying frequencies occur. In general, however, pulsing the air flow 70 at a frequency in the range of 1 to 50 Hz can produce significant excitation of jet 60, with the most substantial entrainment benefits resulting from pulse frequencies with a Strouhal number of 0.112, in the subaudible range below about 20 Hz for a Reynolds number of about 7000. The Strouhal number is defined as the frequency times the width of the nozzle divided by the exit velocity.

EXAMPLE

An example excitation apparatus 10, substantially as described above, was set up and operated to observe jet excitation results. The nozzle 50 was designed to approximate actual diffuser geometries, but with a uniform outlet velocity. The nozzle outlet was 2.54 cm wide by 119 cm long, the width and length being the transverse and longitudinal dimensions, respectively. Isothermal jets and a vertical discharge orientation were used, so that buoyancy forces were minimized. The diffuser 40 was located in a room R, that was 5.2 m wide, 10.7 m long, and 2.6 m high. The nozzle 50 was located away from any walls. The air flow 72 in duct 12 was supplied from a squirrel cage blower located in an adjacent room via a 20.3 cm galvanized duct 12. The pulsator mechanism 20 was located 4.5 m upstream of the nozzle 50. In order to prevent the transmission of mechanical vibration from the pulsator mechanism 20 to the nozzle 50, a section of flexible duct (not shown) was used immediately downstream of the pulsator mechanism 20. An optical tachometer (not shown) with a digital readout detected the rotational speed of the disk 24 directly from the pulley 34. A synchronous belt 35 and pulleys 34 and 37 in the form of sprockets were used to prevent slippage. The motor 36 could be varied in speed from 0 to about 1700 revolutions per minute. The vanes 46 and screens 47 dissipated any turbulent structures introduced to the air flow 70 by the pulsator mechanism 20 to ensure that the fluid structures which had been created by and separated from the pulsator mechanism 20. Therefore, only the pressure pulsations, not the turbulences, created by the pulsator mechanism 20 reached the nozzle 50.

Hot wire anemometry (not shown) was used to collect flow information. Since disturbance frequencies ranged from 2 to 56 Hz, a sampling frequency of 1000 Hz was chosen to provide a power spectral density range of 0.5 to 500 Hz, thereby allowing a sampling of higher harmonies. A sampling time of 120 seconds provided sixty occurrences at the low end of 0.5 Hz, the quarter harmonic of 2 Hz. Velocity histories produced by each test were decomposed to determine the mean, periodic, and random velocities, the velocity fluctuations, the turbulence intensity, and the power spectral density for the test point and condition. The mean velocities from groups of individual test points produced the velocity profiles, which showed the shape and mixing characteristics of the jet.

Figure 4:
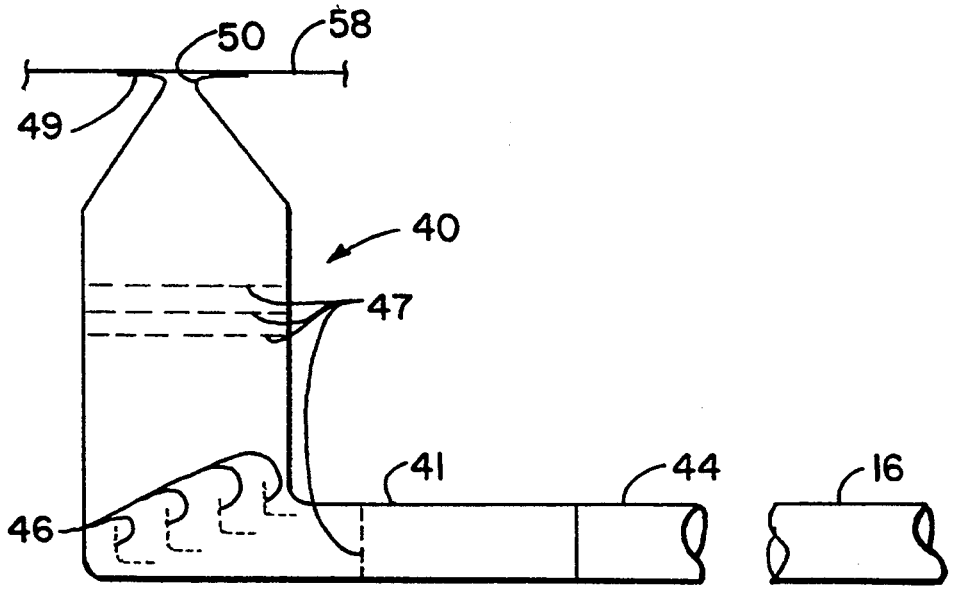
FIG. 4 is a side view of the diffuser having a wire positioned across the width of the nozzle.
Figure 5:
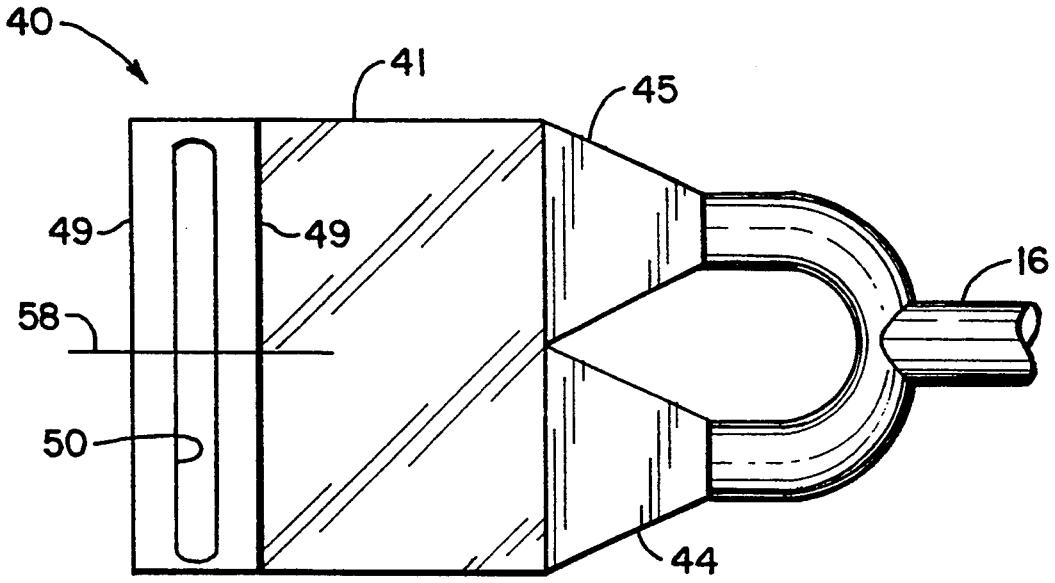
FIG. 5 is a plan view of the diffuser as shown in FIG. 4.

High-speed photographic techniques were used to visualize the structures by which mixing of the jet 60 occurs. By producing smoke at or adjacent the outlet 50 and photographing it, the actual mixing of the jet 60 with the ambient air can be seen. Wire 58, shown in FIGS. 4 and 5, is stretched across the width of nozzle 50 and an oil is then applied to wire 58. Applying a current to wire 58 results in the heating of the oil and smoke is thereby produced. The high frequency and rapid occurrence of the physical events that result in mixing required that short exposures be taken to visualize these events. FIGS. 6–11 illustrate still photographs of the smoke in the jet 60 taken with an exposure of 1/6400 second.

Figure 6:
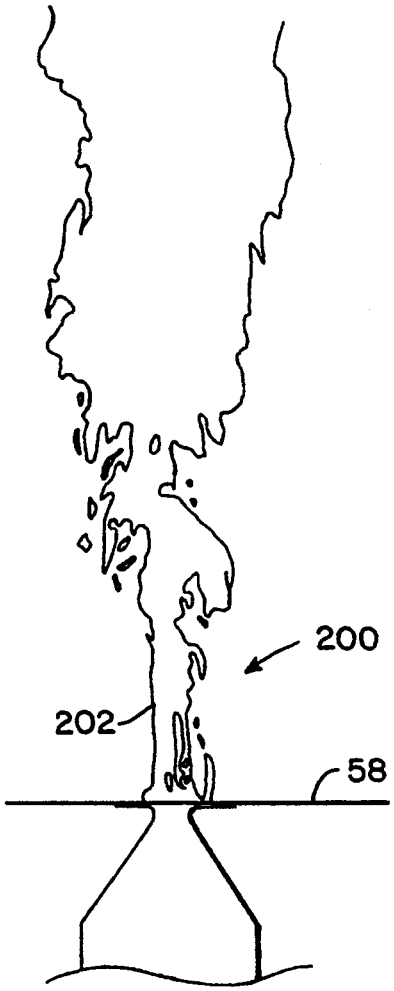
FIG. 6 (Prior Art)
FIG. 6 illustrates smoke generated in the core of a natural jet using the wire shown in FIG. 4, and as visualized using high-speed photography with film speeds at 1/6400 second having a Strouhal number of 0.000.
Figure 7:
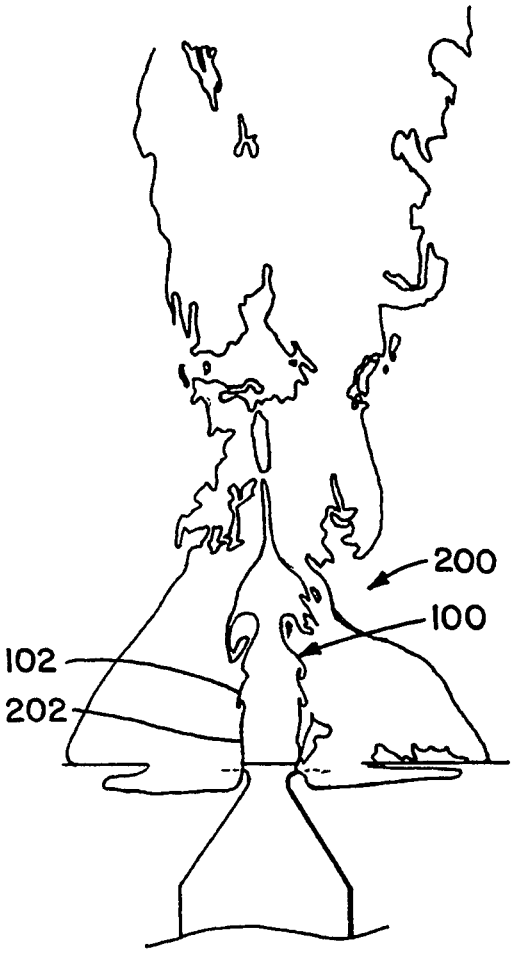
FIG. 7 (Prior Art)
FIG. 7 illustrates smoke generated outside of a natural jet using the wire shown in FIG. 4, and as visualized using high-speed photography with film speeds at 1/6400 second having a Strouhal number of 0.000.
Figure 8:
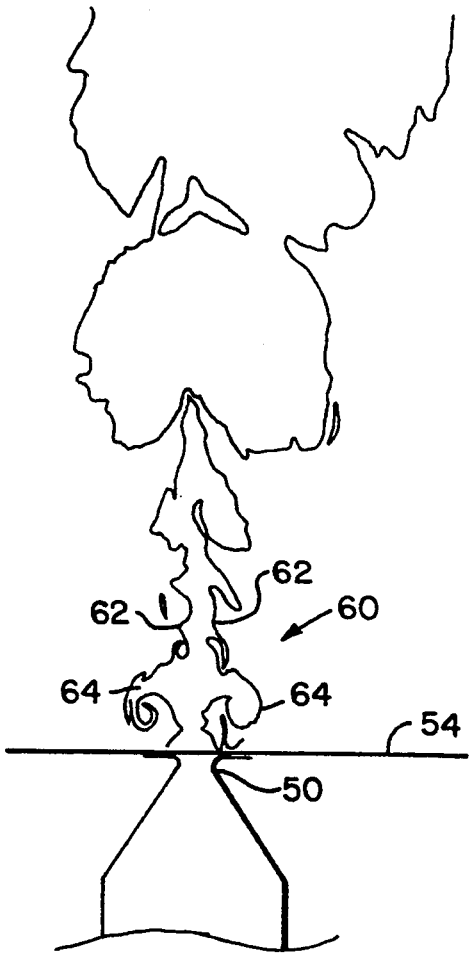
FIG. 8 illustrates smoke generated in the core of an excited jet using the wire shown in FIG. 4, and as visualized using high-speed photography with film speeds at 1/6400 second having a Strouhal number of 0.090.
Figure 9:
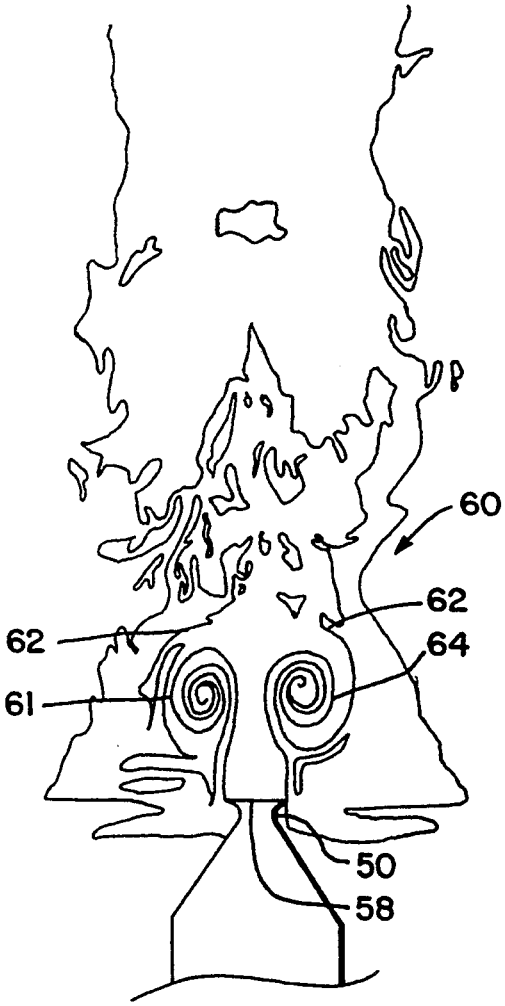
FIG. 9 illustrates smoke generated outside of an excited jet using the wire shown in FIG. 4, and as visualized using high-speed photography with film speeds at 1/6400 second having a Strouhal number of 0.090.

Referring to FIGS. 6 and 7, a natural, nonexcited jet 200 is depicted. As jet 200 exits nozzle 50 spreading occurs slowly, and the vortical structures 100 and 102 appear along the edges 202 of jet 200 in an unordered process.

Rotating disk 24 in the subaudible frequency range, below 20 Hz, results in the production of ordered large vortical structures 64 on the edges 62 of jet 60 as illustrated in FIGS. 8–11. Large amplitude, low frequency excitation of air flow 70 results in a jet 60 having markedly changed fluid structures from those observed in the natural jet 200. The centerline velocity of jet 60 decreases which accompanies an increase in the width of jet 60 at outlet 50. The momentum produced by the decreased velocity is transferred to the mixing layers of the jet 60, thereby, producing large vortical structures 64. Mixing is accomplished through viscous diffusion within the vortex and breakdown of the vortical structures 64.

Figure 10:
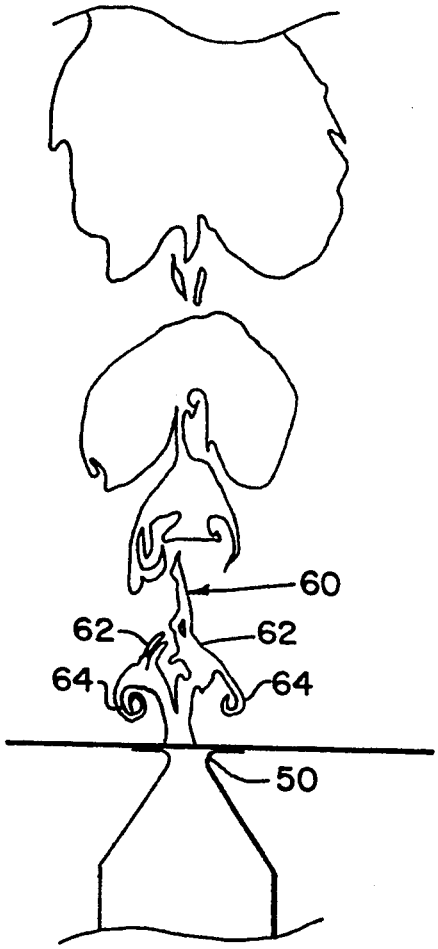
FIG. 10 illustrates smoke generated in the core of an excited jet using the wire shown in FIG. 4, and as visualized using high-speed photography with film speeds at 1/6400 second having a Strouhal number of 0.112.
Figure 11:
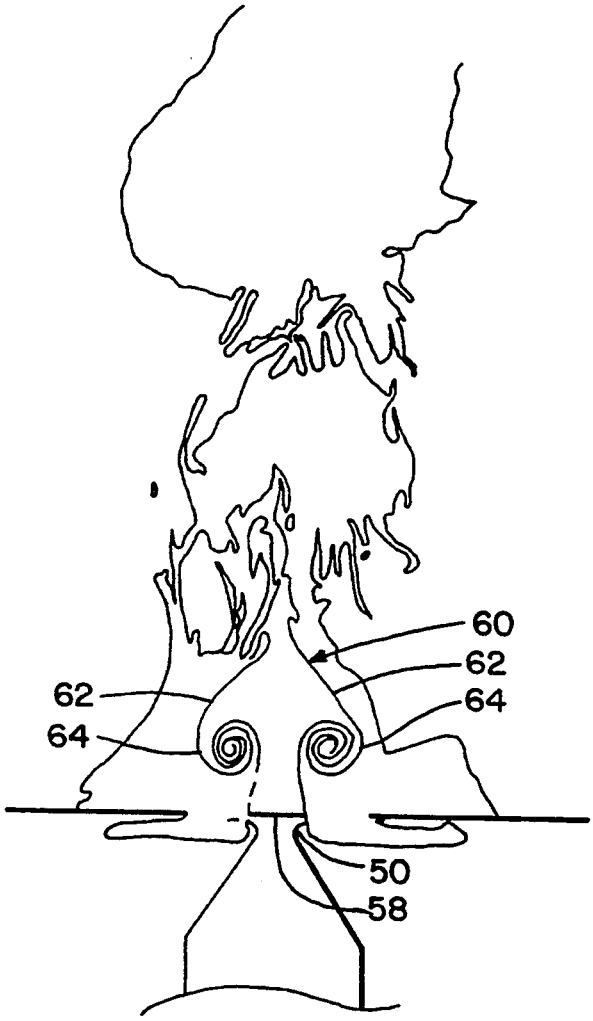
FIG. 11 illustrates smoke generated outside of an excited jet using the wire shown in FIG. 4, and as visualized using high-speed photography with film speeds at 1/6400 second having a Strouhal number of 0.112.

FIGS. 10 and 11 illustrate jet 60 excited at higher frequencies. At higher frequencies, vortices are generated more rapidly and wave lengths are reduced. Again, the natural instabilities of the jet 60 are enhanced by large amplitude, low-frequency excitation, resulting in the formation of symmetric, large vortical structures 64. Mixing is strongly affected by flow fluctuations, whether they are "random " turbulence or periodic in nature. However, when the pulsations are imparted to the air flow 70 at a frequency that matches a natural frequency of the jet 60, the entrainment, spreading, and mixing of the jet 60 with the ambient air in the room R is increased. The subharmonic strength equals that of the fundamental harmonic by about 40 Hz excitation. The lower disturbance frequencies persist longer than the higher excitation frequencies. Lower frequencies affect the flow profile near the nozzle 50, while higher frequencies, although affecting the jet near the nozzle 50, also, have a noticeable effect further downstream. Turbulence intensity of a natural jet is about 1½% while velocity fluctuations of 30%–50% can be achieved by exciting a jet 60 with large amplitude and low frequencies. While the fluid used in the above description was an air stream, other gases or liquids may also be utilized by the present invention.

The foregoing description is considered as illustrative only of the principles of the invention. Furthermore, since numerous modifications and changes will readily occur to those skilled in the art, it is not desired to limit the invention to the exact construction and process shown as described above. Accordingly, all suitable modifications and equivalents may be resorted to falling within the scope of the invention as defined by the claims that follow.

I claim:

1. A method for increasing the spreading, entrainment and mixing of an air flow that is expelled from a plenum into an enclosure with ambient air in the enclosure, including the step of imparting periodic pressure pulsations to the air in the plenum so that the frequency of the pulsations match a natural characteristic frequency of a turbulence in the air flow as the air flow is expelled into the ambient air in the enclosure.

2. The method of claim 1, including the step of matching the frequency of the pulsations with a natural characteristic frequency of vortices occurring sequentially in the air flow as the air flow is expelled into the ambient air in the enclosure.

3. The method of claim 2, including the steps of measuring amplitudes of turbulence in the air flow as the air flow is expelled into the ambient air in the enclosure, and varying the rate of the pulsations in the air flow until the measured amplitudes of turbulence in the air flow is maximum.

4. The method of claim 2, including the steps of measuring the frequency of the vortices produced, and pulsating the air flow at about the same frequency.

5. The method of claim 2, including the steps of determining the natural characteristic frequency of the vortices produced, and pulsating the air flow at a frequency that is a multiple or fraction of said natural characteristic frequency.

6. The method of claim 1, including the steps of imparting periodic pressure pulsations to the air flow by directing the air flow through a confined flow path before expelling the air into said enclosure, and sequentially occluding and opening the flow path.

7. The method of claim 6, including the steps of positioning a disk in the confined flow path in an orientation such that it occludes the flow path in a first position and opens the flow path in a second position.

8. The method of claim 7, including the steps of mounting the disk on a rotatable axle in such a manner that the disk is rotatable repeatedly about an axis defined by said shaft through said first position and said second position, and rotating said disk about said axis.

9. Air distribution apparatus for injecting fresh air into an enclosure containing ambient air, comprising:

a source of fresh air under a higher pressure than the ambient air in the enclosure;

conduit means extending from said source to said enclosure for confining and directing a flow of the fresh air from said source to said enclosure; and pulsator means positioned in the flow of the fresh air between said source and said enclosure for imparting a pulsating variation in pressure in said flow of the fresh air, wherein said pulsator means includes a valve housing for confining the flow of fresh air in a direction that defines a flow axis, and gate means position in said valve housing for sequentially occluding and opening said valve housing to the flow of said fresh air, said gate means including a disk mounted rotatably in said valve housing in a manner that defines an axis of rotation that extends diametrically through said disk and transversely through said valve housing perpendicular to said flow axis, said disk being rotatable about said axis of rotation between a first position that occludes said valve housing to the flow of fresh air and a second position that is open to the flow of fresh air through the valve body.

10. The air distribution system of claim 9, including drive means connected to said disk for rotating said disk between said first position and said second position.

11. The air distribution system of claim 10, including speed control means connected to said drive means for varying the speed of rotation of said disk.

12. The air distribution system of claim 9, wherein said conduit means includes nozzle means for injecting said flow of fresh air into said enclosure.

13. The air distribution system of claim 12, wherein said conduit means includes an enlarged plenum positioned in said conduit means immediately upstream of said nozzle means for equalizing distribution of the flow of fresh air uniformly through the nozzle means.

14. The air distribution system of claim 13, wherein said pulsator means is positioned upstream of said plenum in said flow of fresh air.

15. The air distribution system of claim 12, wherein said nozzle means includes a narrow, elongated opening from said plenum into said enclosure.

16. A method of exciting a free jet of fluid that has natural turbulences at periodic frequencies after the fluid flows through and exits a duct, comprising the step of disturbing said fluid at a frequency that substantially matches a natural frequency of said turbulences.

17. The method according to claim 16, including the steps of creating large amplitude disturbances in said fluid by periodically pulsing said flow of fluid in said duct at said natural frequency.

18. The method of claim 5, including the step of pulsating the air at a frequency in the range of about 2 to 56 hertz.

* * * * *

UNITED STATES PATENT AND TRADEMARK OFFICE

CERTIFICATE OF CORRECTION

PATENT NO. : 5,338,254
DATED : August 16, 1994
INVENTOR(S) : Robert B. Farrington It is certified that error appears in the above-indentified patent and that said Letters Patent is hereby corrected as shown below:

In column 1, line 68, change "ducts" to --duct--.

In column 2, line 53, after "of" insert --the--, and after "jet" insert --,--.

In column 2, line 54, change "tha" to --that--.

In column 3, line 45, after "70" delete --,--.

In column 3, line 64, change "forced air" to --forced-air--.

In column 4, line 12, change "beatings" to --bearings--.

In column 4, line 21, change "90°" to --90--.

In column 5, line 25, after "invention" insert --,--.

UNITED STATES PATENT AND TRADEMARK OFFICE

CERTIFICATE OF CORRECTION

PATENT NO. : 5,338,254

DATED : August 16, 1994

INVENTOR(S) : Robert B. Farrington

It is certified that error appears in the above-indentified patent and that said Letters Patent is hereby corrected as shown below:

In column 6, line 17, after "R" delete —,—.

Signed and Sealed this

Twenty-third Day of May, 1995

Bruce Lehman

*Attest:*

BRUCE LEHMAN

*Attesting Officer*

*Commissioner of Patents and Trademarks*